US005543807A

United States Patent [19]

Stangel

[11] Patent Number: 5,543,807

[45] Date of Patent: Aug. 6, 1996

[54] ELECTRONIC COMMUTATION SWITCH FOR CYLINDRICAL ARRAY ANTENNAS

[75] Inventor: John J. Stangel, Mahopac, N.Y.

[73] Assignee: Loral Corporation, New York, N.Y.

[21] Appl. No.: 337,907

[22] Filed: Nov. 14, 1994

Related U.S. Application Data

[63] Continuation of Ser. No. 981,461, Nov. 25, 1992, abandoned.

[51] Int. Cl.[6] ..... H01Q 3/02; H01Q 3/12

[52] U.S. Cl. ..... 342/374

[58] Field of Search ..... 342/374, 435, 342/406; 333/262, 101, 103, 104, 105

[56] References Cited

U.S. PATENT DOCUMENTS

| | | | |
|---|---|---|---|
| 3,729,742 | 4/1973 | Boyns . | |
| 3,808,566 | 4/1974 | Thompson et al. | 335/152 |
| 3,816,830 | 6/1974 | Giannini . | |
| 3,916,349 | 10/1975 | Ranghelli et al. | 333/31 R |
| 4,035,807 | 7/1977 | Tang et al. | 343/742 |
| 4,061,989 | 12/1977 | Petrelis | 333/7 R |
| 4,216,473 | 8/1980 | Goldfischer et al. . | |
| 4,302,734 | 11/1981 | Stockton et al. | 333/104 |
| 4,635,065 | 1/1987 | Mori et al. | 342/435 |
| 4,800,393 | 1/1989 | Edward et al. | 343/821 |
| 4,837,580 | 6/1989 | Frazita | 342/374 |
| 4,855,748 | 8/1989 | Brandao et al. | 342/455 |
| 4,908,587 | 3/1990 | Davcev | 333/101 |
| 4,924,235 | 5/1990 | Fujisaka et al. | 342/374 |
| 5,027,125 | 6/1991 | Tang | 342/368 |
| 5,028,930 | 7/1991 | Evans | 342/373 |
| 5,033,108 | 9/1991 | Lockwood | 455/12 |
| 5,146,230 | 9/1992 | Hules | 342/374 |
| 5,257,031 | 10/1993 | Scarpetta et al. | 342/374 |

*Primary Examiner*—Theodore M. Blum

*Attorney, Agent, or Firm*—Seymour Levine; Stanton D. Weinstein

[57] ABSTRACT

Commutation switches for electronically scanning cylindrical arrays are disclosed. One embodiment reduces the number of transfer switches needed in a commutation switch by utilizing the commutation inversion property inherent to transfer switches having a binary number of input and output ports. A second embodiment having inversion capability provides a transfer switch with non-binary number of input and output ports. Commutation switches employing transfer switches of the second embodiment exhibit reduced complexity over the prior art and provide lower signal loss than that achievable with commutation switches of the prior art.

20 Claims, 10 Drawing Sheets

STATE 0

STATE 1

FIG. 3.
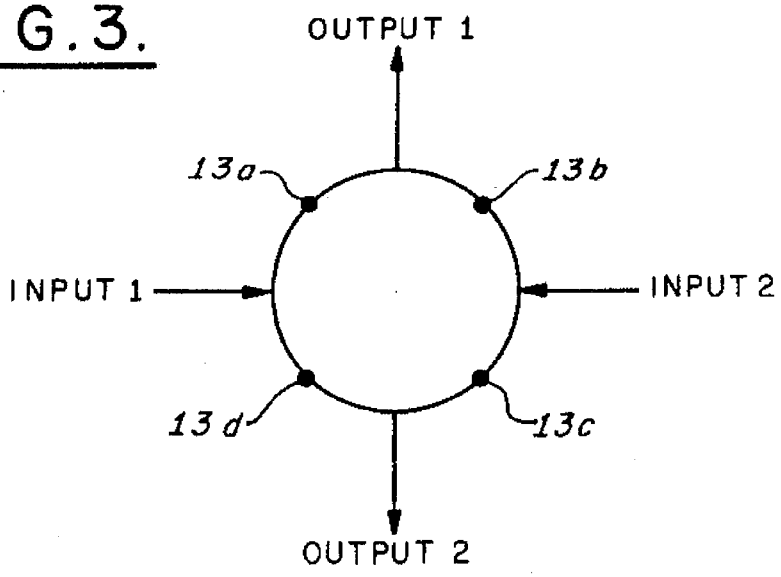
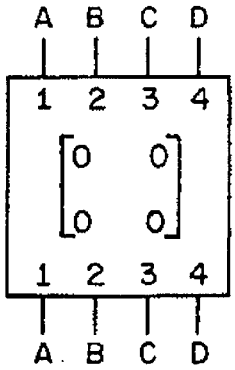
FIG. 4A.
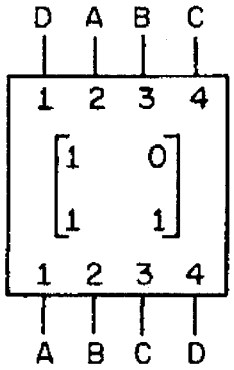
FIG. 4B.
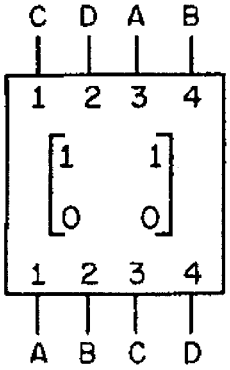
FIG. 4C.
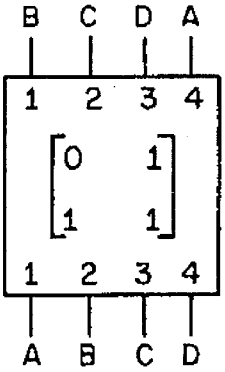
FIG. 4D.
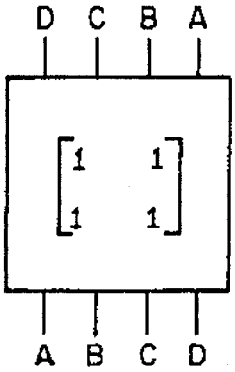
FIG. 5A.
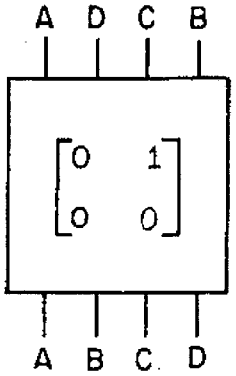
FIG. 5B.
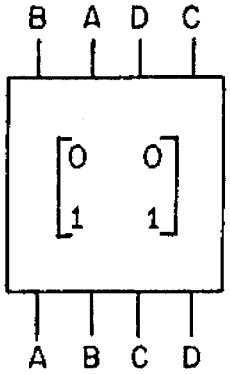
FIG. 5C.
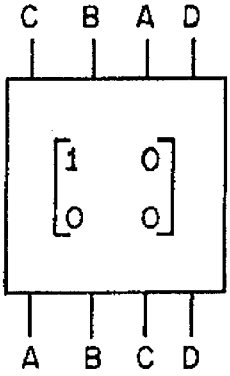
FIG. 5D.

ELECTRONIC COMMUTATION SWITCH FOR CYLINDRICAL ARRAY ANTENNAS

This application is a continuation application Ser. No. 07/981,461, filed Nov. 25, 1992, now abandoned.

BACKGROUND OF THE INVENTION

1. Field of the Invention

The invention pertains to the field of electronically scanned antennas and more particularly to commutation switches for electronically scanned cylindrical arrays.

2. Description of the Prior Art

A cylindrical array comprises a multiplicity of individual radiating elements arranged in columns and rings. In such an array, a directive antenna beam is formed by simultaneously exciting the columns with an amplitude and phase distribution (illumination function) that produces the desired antenna pattern. This beam may be electronically scanned about the cylinder axis by commuting the illumination function around the columns of the cylindrical array with the utilization of electronic switching circuits.

A binary commutation switch for commuting the illumination function around the columns of the cylindrical array, thereby scanning the antenna about the axis of the cylinder, is disclosed by Giannini in U.S. Pat. No. 3,816,830. In accordance with the Giannini disclosure a multiplicity of 2×2 transfer switches form a N×N commutation switch, where $N=2^n$ and n is an integer. The total number of 2×2 switches in the N×N commutation switch is Nn/2. Single pole-two-throw (SP2T) and single-pole-three-throw (SP3T) switches may be coupled to each output port of the N×N commutation switch to respectively scan cylindrical array antennas with 2N and 3N columns. In general, SPMT switches may be added to the N×N commutation switch to scan a cylindrical array of MN columns, where M is the number of antenna columns switchably coupled to each output port of the commutation switch.

Utilization of the Giannini commutation switch in large cylindrical arrays requires a significant number of transfer switches, appreciably adding to cost of the array. A commutation switch which provides an appreciable reduction in the number of transfer switches is therefore desirable.

SUMMARY OF THE INVENTION

In a first embodiment of the invention a commutation circuit for scanning an array of N columns, with symmetric or antisymmetric illumination functions, comprises two N/2×N/2 commutation switches. This arrangement reduces the number of transfer switches by N/2 with the concomitant increase in reliability, and reduction in cost, complexity, and signal loss. The reduction in the number of transfer switches is realized by recognizing that a commutation switch can provide two types commutations, one being the inverse of the other.

In a second embodiment of the invention transfer switches having a number of ports that are not related to a binary number are employed in a commutation switch. These non-binary transfer switches are capable of the two types of commutations wherein one commutation is the inverse of the other. Thus, a 3×3 transfer switch may be employed to provide a N×N commutation switch in which $N=3^n$, n being an integer. This commutation switch contains N/3 individual 3×3 transfer switches and may be combined with SPMT switches at each output port to increase the elements that can be fed by the commutation switch.

The 3×3 transfer switch may be combined with 2×2 transfer switches to form a N×N commutation switch in which $N=2^m.3^n$, where m and n are integers, thus allowing a much wider choice of N. These commutation switches contain mN/2 individual 2×2 switches and nN/3 individual 3×3 switches. The 2×2 and 3×3 switch arrangement may also be combined with SPMT switches at each output jport to increase the number of antenna colummns which can be fed.

BRIEF DESCRIPTION OF THE DRAWINGS

FIG. 3 is a representation of the circuit topology of a 2×2 transfer switch.

FIGS. 4A–4D are representations of commutation states of the 4×4 transfer switch shown in FIG. 1.

FIGS. 5A–5D are representations of commutation switch inversion states corresponding to the commutation states shown in FIGS. 4A–4D.

DESCRIPTION OF THE PREFERRED EMBODIMENTS

Figure 1:
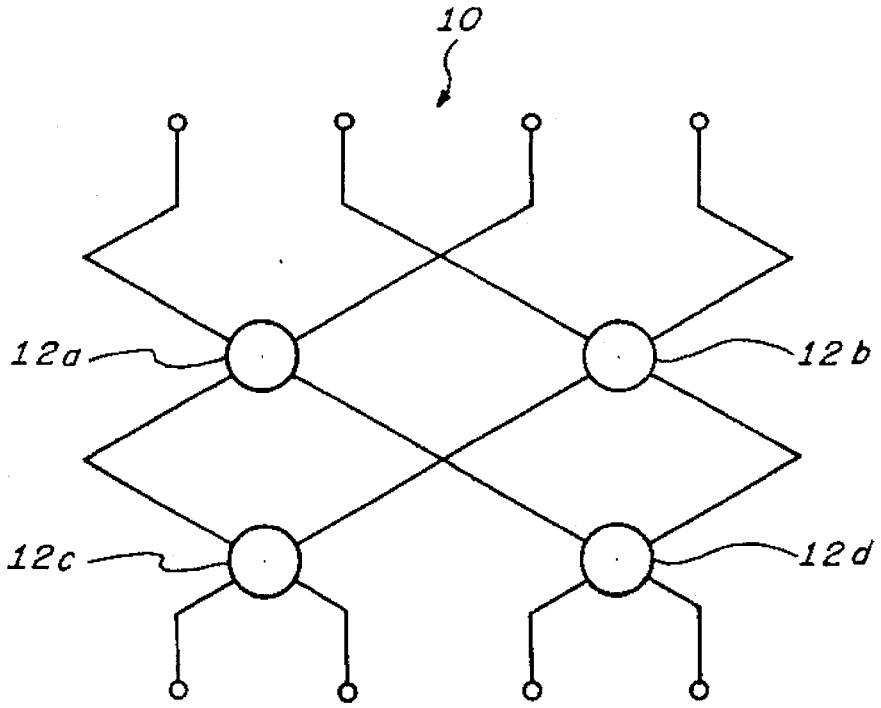
FIG. 1 is schematic diagram of a 4×4 transfer switch.

This 4×4 transfer switch comprises four 2×2 transfer switches 12*a*–12*d*. Each 2×2 switch has two states representing the two possible interconnections of its input and output ports and designated state 0 and state 1 as illustrated in FIG. 2. Such a 2×2 transfer switch may be realized in stripline using four diodes 13*a*–13*d* in the circuit topology shown in FIG. 3. The diodes 13*a*–13*d* may be shunted between the circular stipline 14 and located such that the distance between the diode and the adjacent input and output ports is a quarter wavelength (g/4). Thus when a diode is biased in the conducting state an open circuit is seen by the input and output ports looking into the stripline segment towards the conducting diode. When a diode is biased in the non-conducting state, the input and output posts adjacent to the diode are electrically coupled. It should be apparent that a state matrix for the 4×4 transfer switch shown in FIG. 1 in terms of the 2×2 transfer switches of which it is composed and may be represented as $$\begin{bmatrix} a & b \\ c & d \end{bmatrix}$$

wherein each of the elements are 0 or 1 depending on the state of the corresponding 2×2 transfer switch. Consequently each diode has the capability of electronically making or breaking the connection between an input port and an output port depending on its bias condition. Therefore, if the connection is made at diodes 13*a*and 13*d* input 1 is connected to output 1 and input 2 is connected to output 2, and the switch is said to be in state 0. Conversely, if the connection is broken at diodes 13*a* and 13*d* while made at diode 13*b* and 13*d*, input 1 is connected to output 2 and input 2 is connected to output 1, and the switch is said to be in state 1.

Figure 2A:
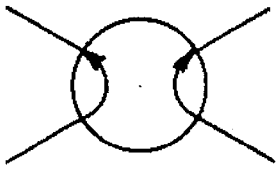
FIGS. 2A and 2B are schematic diagrams of the input-output connections for the states of a 2×2 transfer switch.
Figure 2B:
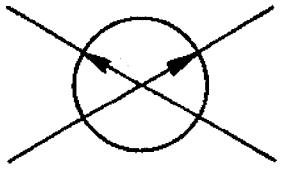

Refer now to FIGS. 4A–4D wherein representations of four classical commutation states and the corresponding state matrix of the 4×4 transfer switch depicted in FIG. 1 are shown. FIG. 4A illustrates the straight-through condition for which signal A, B, C, and D imposed at input ports 1 through 4 correspondingly appear at output ports 1 through 4 respectively.

FIG. 4B shows the first commutation condition for which the input signals A, B, C and D are sequenced to output ports 2, 3, 4, and 1 respectively. Similarly, the second and third commutation condition are illustrated in FIGS. 4C and 4D. The stated interconnections can be verified by tracing paths from input to output through the circuit topology of FIG. 1 for the indicated state of each 2×2 transfer switch. FIGS. 5A–5D illustrates the inversion condition corresponding to each commutation condition of FIGS. 4A–4D. Note that the inversion effected by reversing the state of each constituent 2×2 switch interchanges the output ports so that A-D, D-A, B-C, and C-B. Further note that the state matrix and its inverse are complementary, that is the sum of the corresponding elements in the state matrix and its inverse is equal to 1.

Figure 6:
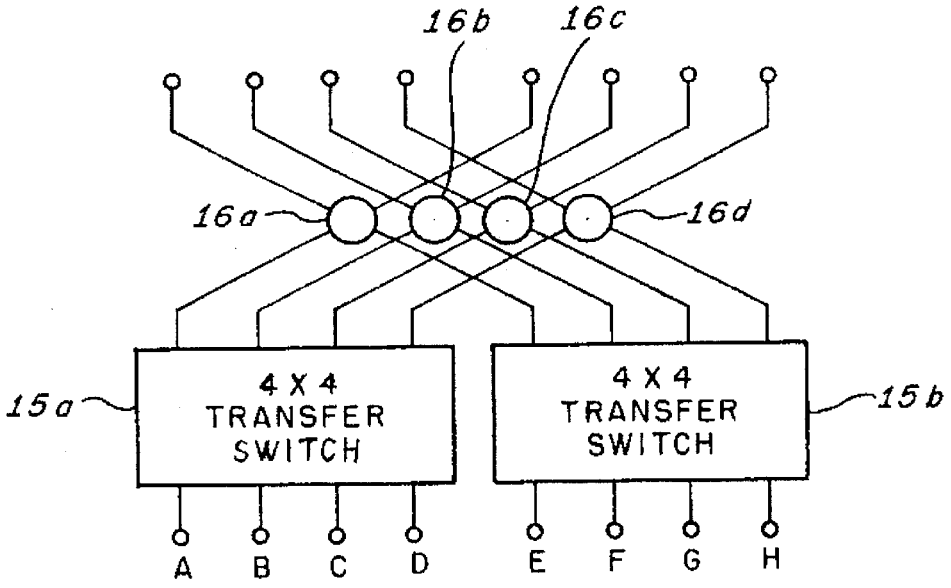
FIG.6. PRIOR ART
FIG. 6 is a schematic diagram of an 8×8 commutation switch in accordance with the prior art.

FIG. 6 shows the circuit topology of an 8×8 commutation switch 20 designed in accordance with the prior art. This switch comprises two 4×4 transfer switches 15*a* and 15*b* respectively and four 2×2 transfer switches 16*a*–16*d*. The state matrix for this configuration may be given as $$\left[\begin{array}{c|c} a_1 \mid b_1 & c_1 \mid d_1 \\ \hline A_1 & B_1 \end{array}\right]$$

where A, and B, are respectively the state matrices of the 4×4 transfer switches 15*a* and 15*b* and the elements $a_1$–$d_1$ are the respective states of the 2×2 transfer switches 16*a*–16*d*. Given A, B, C, D, E, F, G and H as the sequence of signals at the input ports, the sequence of signals at the output ports for each of the eight commutation states is given as:

| | | | |
|---|---|---|---|
| State 1: | ABCDEFGH | State 5: | EFGHABCD |
| State 2: | HABCDEFG | State 6: | DEFGHABC |
| State 3: | GHABCDEF | State 7: | CDEFGHAB |
| State 4: | FGHABCDE | State 8: | BCDEFGHA |

The corresponding state matrices for each of these sequences are as follows:

$$\text{state 1:}\ \left[\begin{array}{c} 0|0|0|0 \\ \hline 0\,0|0\,0 \\ | \\ 0\,0|0\,0 \end{array}\right] \qquad \text{State 5:}\ \left[\begin{array}{c} 1|1|1|1 \\ \hline 0\,0|0\,0 \\ | \\ 0\,0|0\,0 \end{array}\right]$$

$$\text{State 2:}\ \left[\begin{array}{c} 1|0|0|0 \\ \hline 1\,0|1\,0 \\ | \\ 1\,1|1\,1 \end{array}\right] \qquad \text{State 6:}\ \left[\begin{array}{c} 0|1|1|1 \\ \hline 1\,0|1\,0 \\ | \\ 1\,1|1\,1 \end{array}\right]$$

$$\text{State 3:}\ \left[\begin{array}{c} 1|1|0|0 \\ \hline 1\,1|1\,1 \\ | \\ 0\,0|0\,0 \end{array}\right] \qquad \text{State 7:}\ \left[\begin{array}{c} 0|0|1|1 \\ \hline 1\,1|1\,1 \\ | \\ 0\,0|0\,0 \end{array}\right]$$

$$\text{State 4:}\ \left[\begin{array}{c} 1|1|1|0 \\ \hline 0\,1|0\,1 \\ | \\ 1\,1|1\,1 \end{array}\right] \qquad \text{State 8:}\ \left[\begin{array}{c} 0|0|0|1 \\ \hline 0\,1|0\,1 \\ | \\ 1\,1|1\,1 \end{array}\right]$$

The state matrix for this 8×8 transfer switch is given as:

$$[A_2 \mid B_2]$$

where $A_2$ is the state matrix of transfer switch 17*a* and $B_2$ is the state matrix of transfer switch 17*b*. Note the absence of the row of 2×2 transfer switches. The operation of this switch is explained with regard to symmetric and anti-symmetric input signal sequences: A,B,C,D,D,C,B,A and A',B',C',D',-D',-C',-B',-A', respectively. These sequences could represent simultaneous sum and delta illumination functions for a monopulse radar. The commutation switch states are accordingly given in terms of the output sequence as follows:

| Sum Sequence | Delta Sequence |
|---|---|
| State 1: ABCDDCBA | A'B'C'D'D'C'B'A' |
| State 2: AABCDDCB | A'–A'–B'–C'–D'D'C'B' |
| State 3: BAABCDDC | –B'–A'A'B"C"D"–D'–C' |
| State 4: CBAABCDD | C'B'A'–A'–B'–C'–D'D' |
| State 5: DCBAABCD | –D'–C'–B'–A'A'B'C'D' |
| State 6: DDCBAABC | –D'D'C;B'A'–A'–B'–C' |
| State 7: CDDCBAAB | C'D'–D'–C'–B'–A'A'B |
| State 8: BCDDCBAA | –B'–C'–D'D'C'B'A'–A' |

Both sequences are commuted in the same manner. The delta sequence, however, has a polarity reversal between adjacent states. In a monopulse radar, this will cause the sign of the error signal to change between adjacent beams. Although this will not alter system performance, the sign change must be recognized in the data processor to properly interpret track data. The corresponding state matrices for the switch are as follows:

$$\text{State 1:}\ \left[\begin{array}{c} 0\,0|0\,0 \\ | \\ 0\,0|0\,0 \end{array}\right] \qquad \text{State 5:}\ \left[\begin{array}{c} 1\,1|1\,1 \\ | \\ 0\,0|0\,0 \end{array}\right]$$

$$\text{State 2:}\ \left[\begin{array}{c} 0\,1|1\,1 \\ | \\ 0\,0|1\,1 \end{array}\right] \qquad \text{State 6:}\ \left[\begin{array}{c} 1\,0|0\,0 \\ | \\ 0\,0|1\,1 \end{array}\right]$$

$$\text{State 3:}\ \left[\begin{array}{c} 1\,0|1\,0 \\ | \\ 1\,1|1\,1 \end{array}\right] \qquad \text{State 7:}\ \left[\begin{array}{c} 0\,1|0\,1 \\ | \\ 1\,1|1\,1 \end{array}\right]$$

-continued

State 4: $\begin{bmatrix} 0\,0|0\,1 \\ | \\ 1\,1|0\,0 \end{bmatrix}$ State 8: $\begin{bmatrix} 1\,1|1\,0 \\ | \\ 1\,1|0\,0 \end{bmatrix}$ It should be apparent that the normal commutation states of the 4×4 transfer switches shown in FIGS. 4A–4D and the inversion states shown in FIGS. 5A–5D are used to produce the above commutation states for the novel 8×8 switch.

Figure 7:
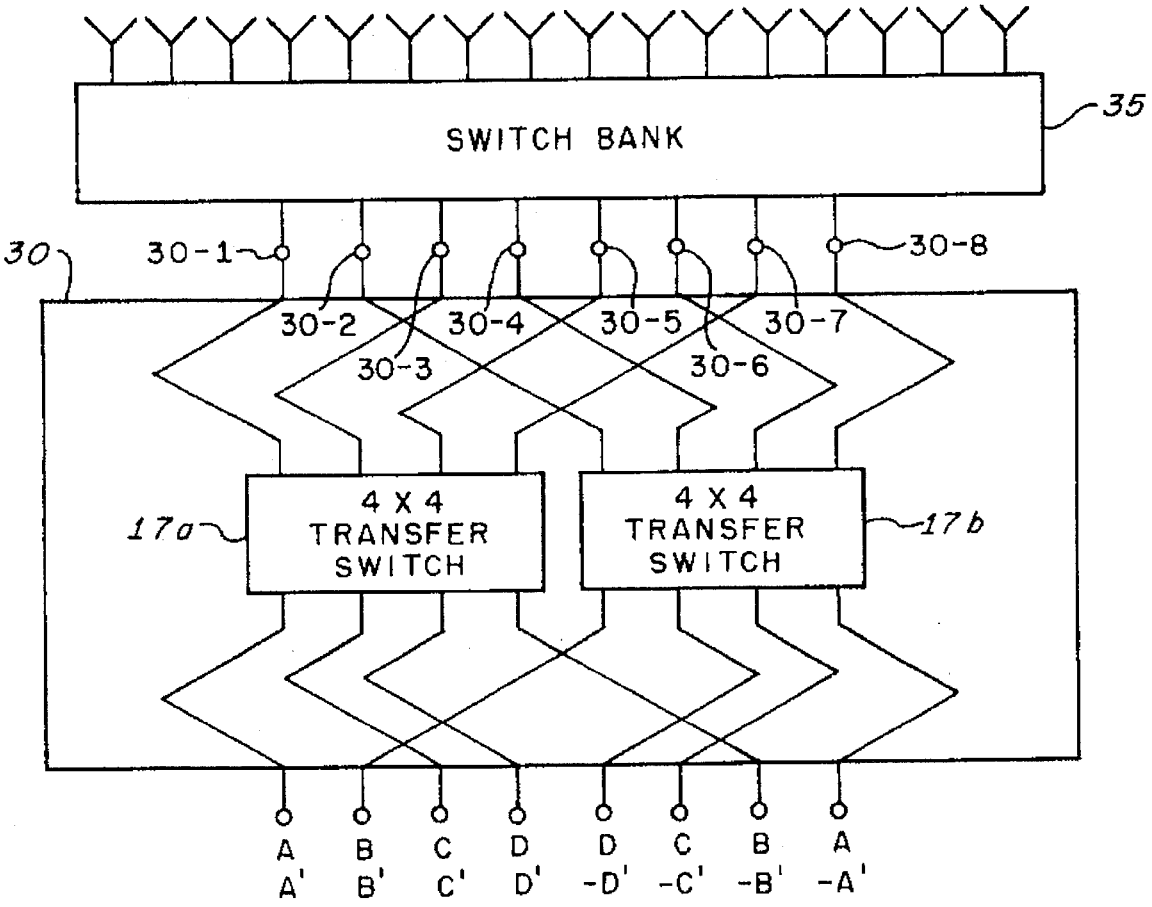
FIGS. 7A–7C are schematic diagram of an 8×8 commutation switch in accordance with the invention.

It should also be apparent that the commutation switches shown in FIGS. 6 and 7 commute the signals at the eight input ports only about the eight output ports and without additional components can not provide the necessary couplings to elements of a cylindrical array to affect the desired beam scanning. Appropriate couplings to elements about the cylinder to realize beam scanning of a 16 element cylindrical array can be accomplished with the 8×8 commutation switch 30 of FIG. 7 by adding a switch bank 35 containing eight single pole two throw switches (SP2T).

Figure 7A:
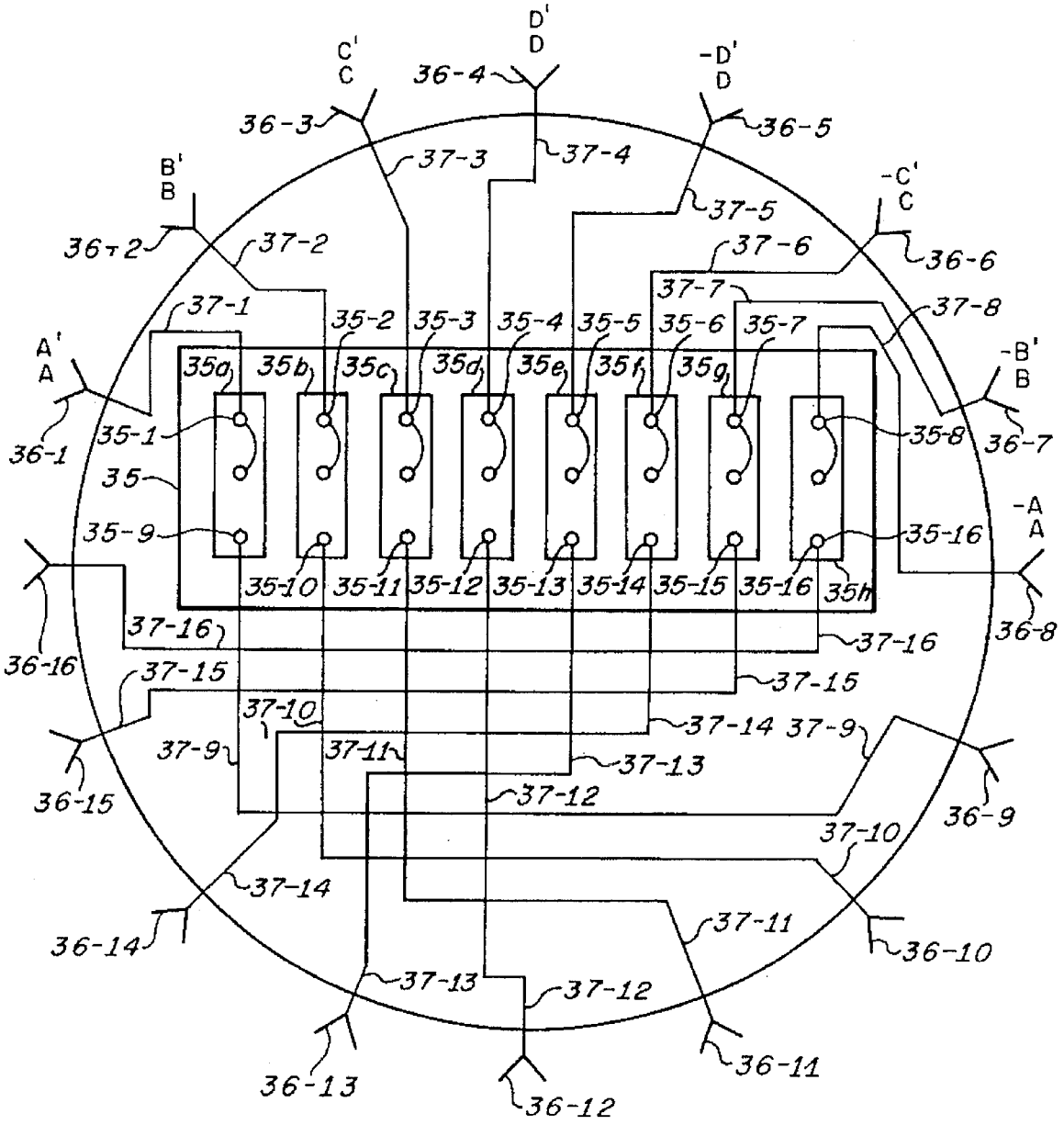
Figure 7B:
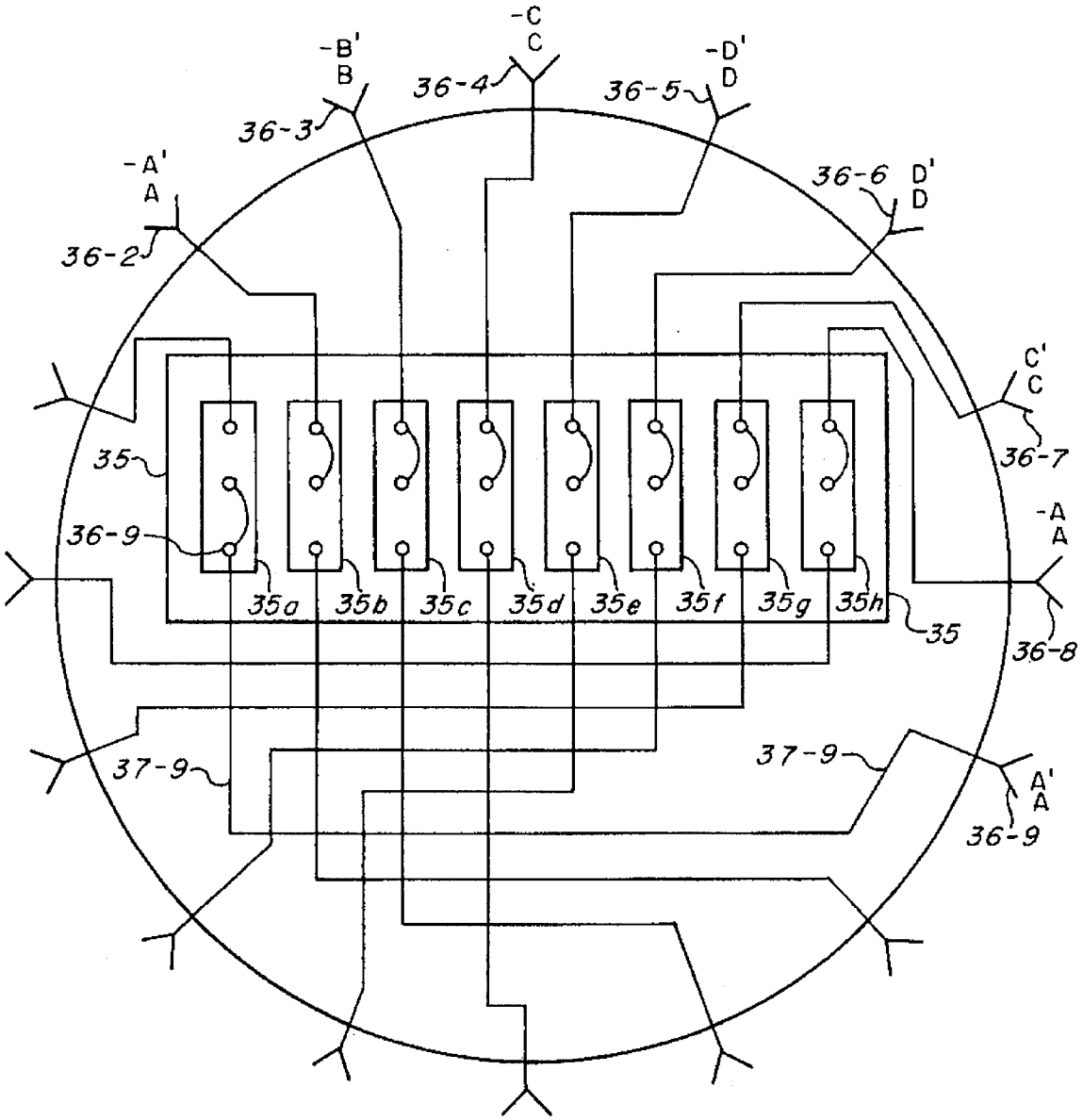
Figure 7C:
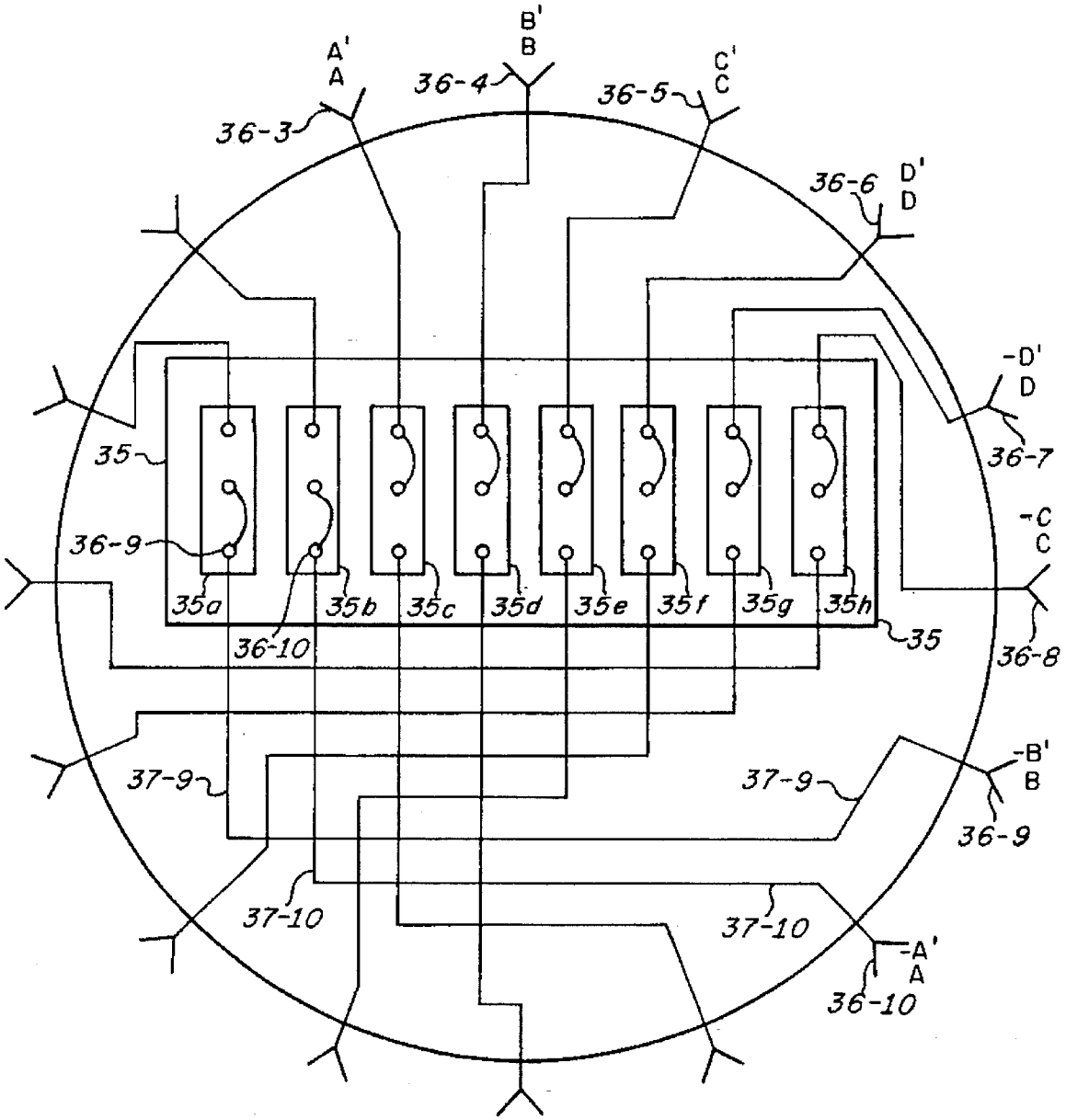

Refer now to FIGS. 7A–7C wherein the couplings of the SP2T switches in the switch bank 35 are shown. As shown in FIGS. 7A through 7C, the first secondary ports 35-1 through 35-8 of SP2T switches 35*a* through 35h are respectively coupled to array elements 36-1 through 36-8 via lines 37-1 through 37-8, while the second secondary ports 35-9 through 35-16 are respectively coupled to array elements 36-9 through 36-16 via lines 37-9 through 37-16. The primary ports of the SP2T switches 35*a* through 35h are respectively coupled to the output ports 30-1 through 30-8 of commutation switch 30 (FIG. 7). When the commutation switch 30 is in State 1, the primary ports of SP2T switches 35*a* through 35h may be coupled to the respective secondary ports 35-1 through 35-8 and therefrom to array elements 36-1 through 36-8, respectively, thereby coupling the signal sequence of State 1 array elements as shown in FIG. 7A.

When the commutation switch 30 is in State 2, the primary port of SP2T switch 35*a* is coupled to the secondary port 36-9 thereby coupling the signals A and A' via line 37-9 to array element 36-9. Thus the beam has been scanned and the signal sequence has been maintained, though as previously stated the delta sequence has a polarity reversal.

Refer now to FIG. 7C to provide the proper array element coupling for the State 3 sequences the primary ports of SP2T switches 35*a* and 35*b* are respectively coupled to the secondary ports 36-9 and 36-10. Consequently, the signal pairs B, -B' and A, -A' are respectively coupled via lines 37-9 and 37-10 to array element 36-9 and 36-10, establishing the signal sequences at the array elements 36-3 to 36-10 shown in FIG. 7C. It is apparent that the signal sequences are maintained for the scan angle of State 3 and the proper polarity of the delta sequence is provided. Though the above example of cylindrical array scanning considered eight active array elements and a sixteen element cylindrical array, it should be recognized that the number of radiating and array elements is not restricted. Any binary number $N_1$ of active array elements and any number $N_2$ of cylindrical array elements may be chosen, provided $N_2/N_1$ is an integer M and SPMT switches are utilized to provide scanning and proper signal sequencing.

Although the principles of the invention are illustrated with respect to a comparatively simple 8×8 commutation switch, it will be recognized by those skilled in the art that the invention is applicable to all commutation switches in which the number of elements N is a binary number.

Commutation and inversion capabilities may be implemented in non-binary transfer switches, as for example, a 3×3 transfer switch which requires but 9 diodes. The principles of the non-binary switch will hereafter be explained with reference to a 3×3 switch, although it will be recognized that 4×4, 5×5 and larger switches may be designed using the same principles.

A 3×3 transfer switch manifesting the desired commutation and inversion properties may be built using six single-pole-three-throw (SP3T) switches as shown in FIGS. 8A–8D. A SP3T switch has the property of electronically interconnecting a primary port to any one of three secondary ports. As shown in the figures, a 3×3 transfere switch may comprise three input SP3T switches and three output SP3T switches. The primary ports of the input SP3T switches constitute the input ports of the transfere switch and the primary ports of the output switches constitute the output ports of the transfer switch, while the secondary ports of the input and output switches are interconnected such that there is a route between each input switch and each output switch. This architecture facilitates all possible interconnections between the input port and the output ports.

The 3×3 transfer switches shown in FIGS. 8A–8D are identical. These Figures show the transfer switch in four different states; the states shown in FIGS. 8C and 8D being the inversion states of those shown in FIGS. 8A and 8B, respectively. Referring to FIGS. 8A–8D, three input SP3T switches 18*a*–18*c* are coupled to three output SP3T switches 19*a*–19*c*. The first secondary port of switch 18a is coupled via line 20*a* to the first secondary port of output switch 19*a*, while the second and third secondary ports are respectively coupled via lines 20*b*, and 20*c* to the first secondary ports of output switches 19*b* and 19*c*. Similarly, the first, second, and third secondary ports of input switch 18*b* are respectively coupled via lines 21*a*–21*c* to the second secondary port of output switches 19*a*, 19*b*, and 19*c*. In like manner the first, second, and third secondary ports are respectively coupled via lines 22*a*–22*c* to the third secondary port of output switches 19*a*–19*c*. The three primary ports 18*d*–18*f* of the input SP3T switches 18*a*–18*c* and the three primary ports 19*d*–19*f* of the output SP3T switches 19*a*–19*f*, respectively serve as the input and output ports of the 3×3 transfer switch.

Figure 8A:
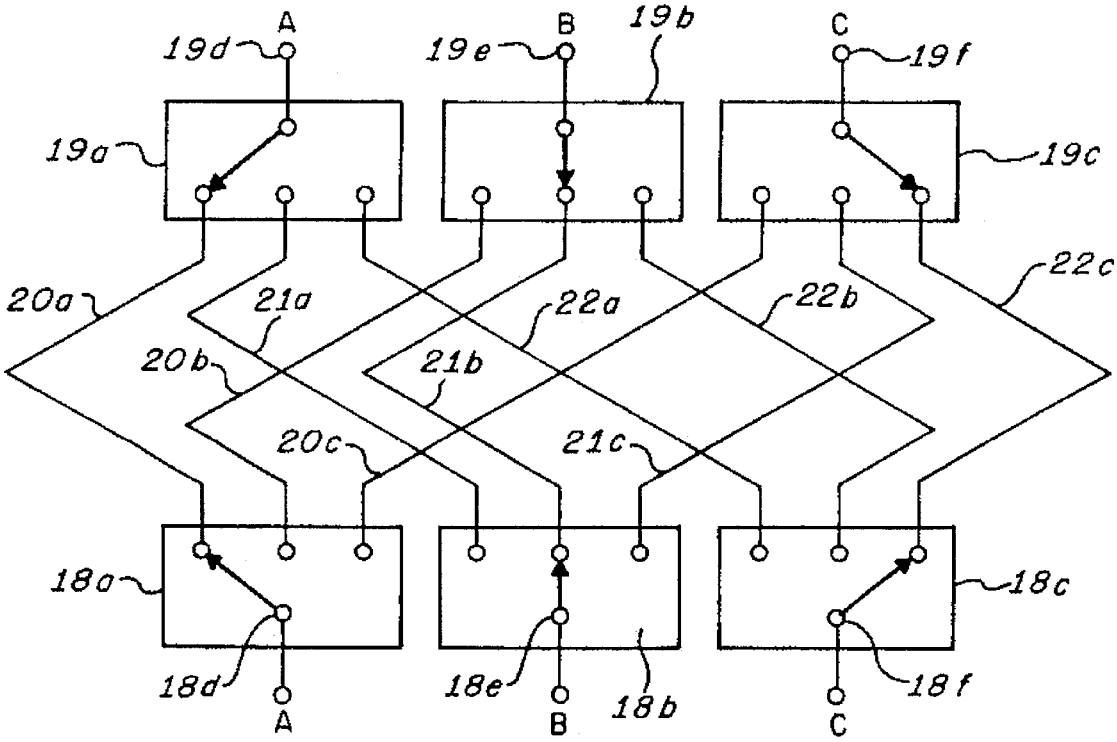
FIGS. 8A–8D are schematic diagrams of 3×3 transfer switches in various state conditions.
Figure 8B:
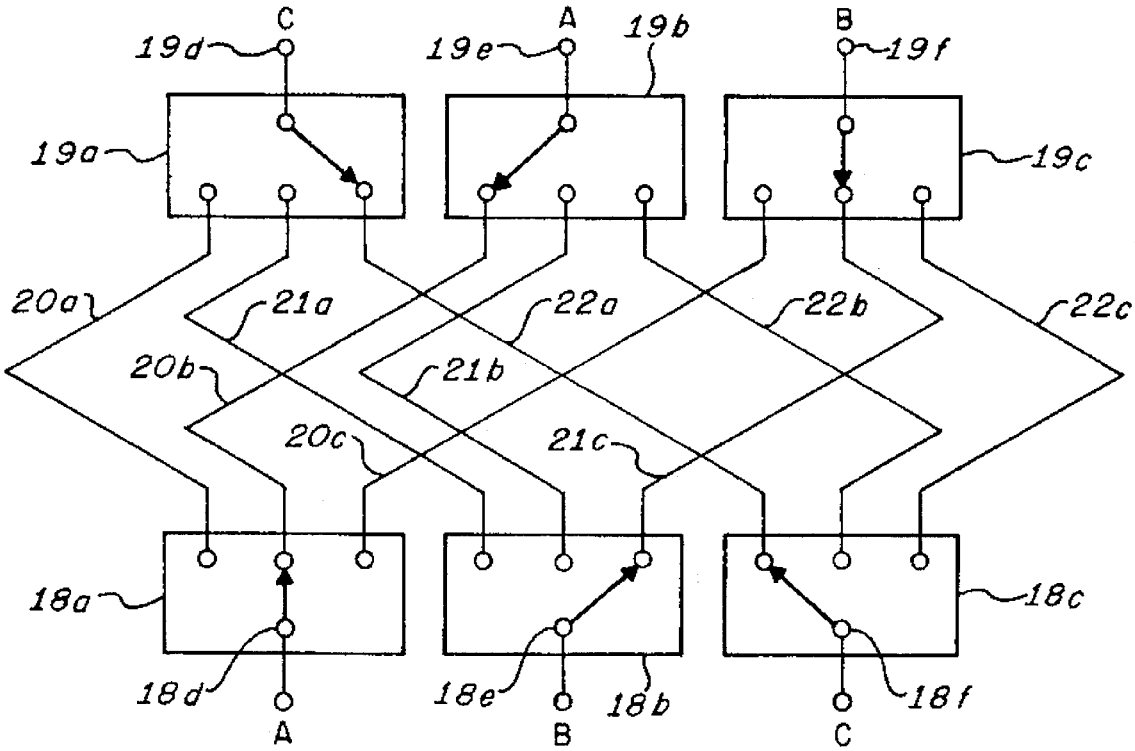
Figure 8C:
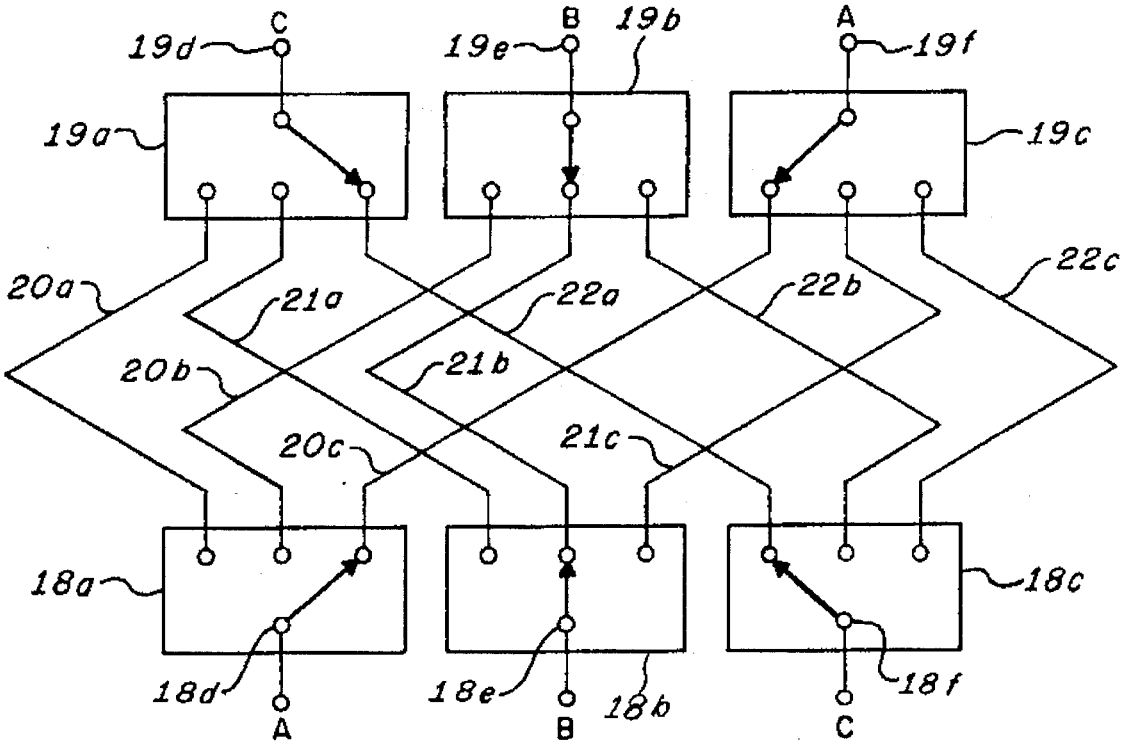
Figure 8D:
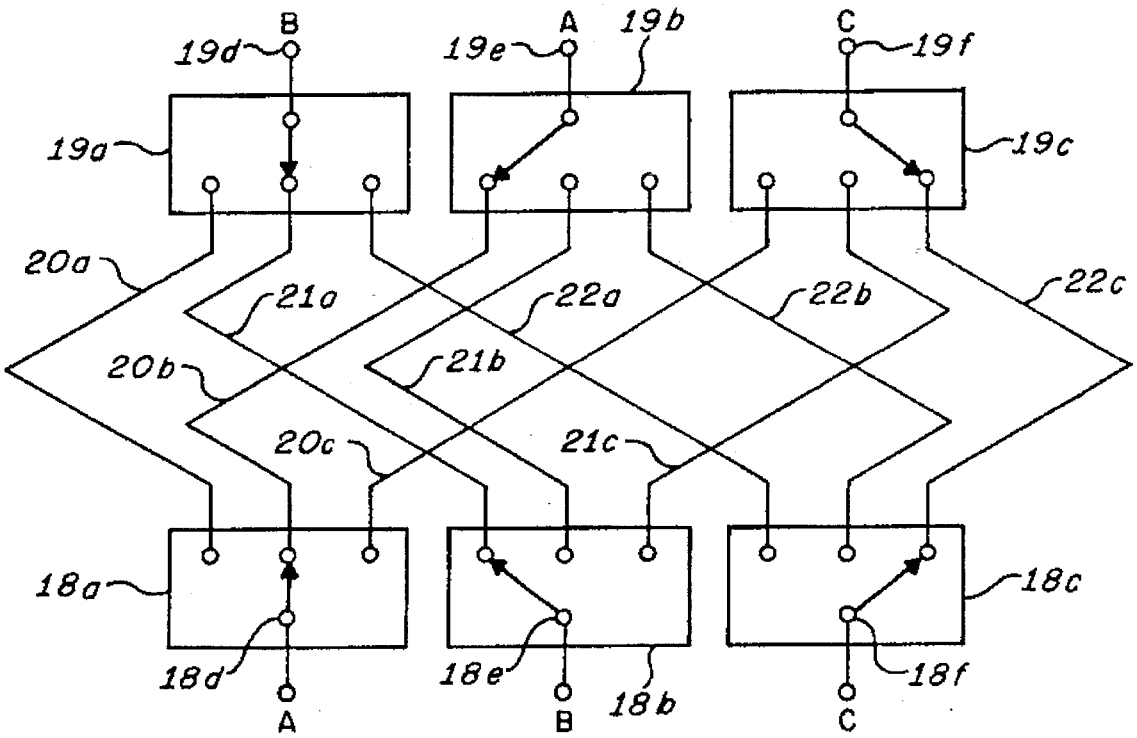
Figure 9:
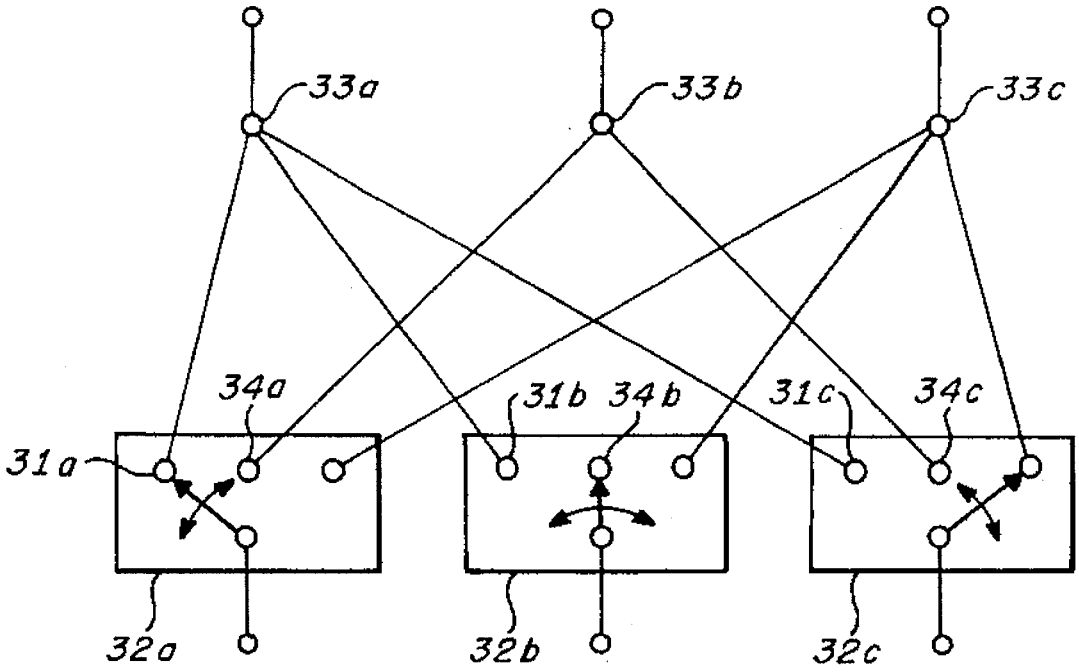
FIG. 9 is a schematic diagram of a 3×3 commutation switch utilizing one single pole three throw (SP3T) switch.
Figure 10:
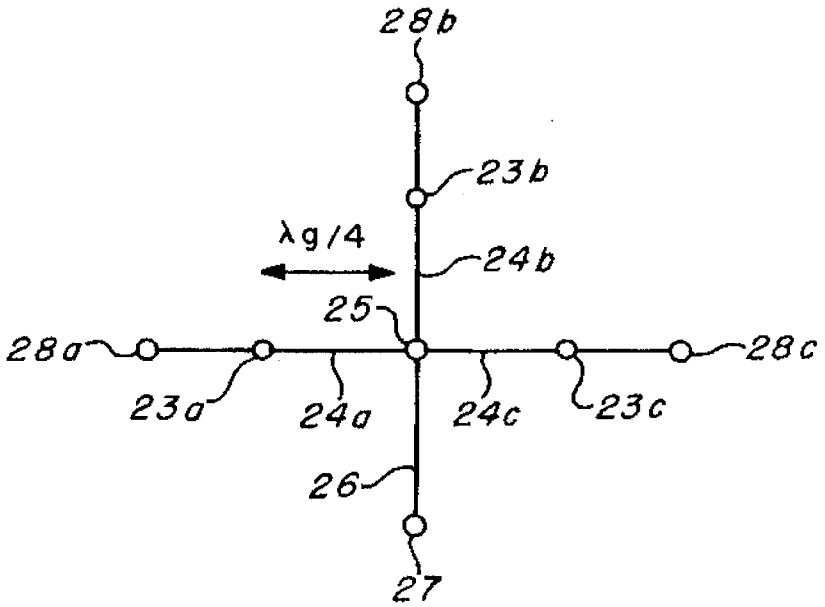
FIG. 10 shows a diode arrangement.

A major disadvantage of this architecture, as shown in FIG. 10, is that it contains eighteen diodes, since three diodes are needed in each SP3T switch. The diodes 23*a*–23*c* may be respectively shunted between the secondary output lines 24*a*–24*c* and a ground plane not shown. Connections to the secondary ports are made by applying a cut-off bias to the diode corresponding to the secondary port which is to be coupled to the primary port and applying a conducting bias to the diodes associated with the other two secondary ports. The three diodes 23*a*–23*c* are positioned a quarter wavelength ($\lambda g/4$) from the junction 25 of a line 26 leading to the primary port and the three lines 24*a*–24*c* leading to the secondary ports. Thus, when a conducting bias is applied to a diode an open circuit is presented at the junction for that line and only the line associated with the diode biased beyond cut-off couples a signal from the primary port to a secondary port. Consequently, when a connection is made, as for example, by diode 23*a*, the connection is broken at diodes 23*b* and 23*c* and the primary port 27 is coupled to secondary port 28*a*. Alternatively, making the connection only at diodes 23*b* or 23*c* will coupled the primary port to secondary ports 28*b* or 28*c*, respectively. When six SP3T switches operate as a 3×3 transfer switch as shown in FIGS. 8A, the diodes associated with the secondary ports coupled to the respective primary ports are similarly biased for all meaningful states of the transfer switch. The diode pairs associated with interconnected secondary ports may therefore, in principle, be replaced by a single diode, thereby reducing the number of diodes to nine per transfer switch, creating the transfer switch shown in FIG. 9.

Referring to the figure, the first secondary ports 31*a*–31*c* of SP3T switches 32*a*–32*c* are coupled to a first output port 33, while the second secondary ports 34*a*–34*c* of each of the SP3T switches are coupled to a second output port 33*b* and the third secondary ports 35*a*–35*c* of each of the SP3T switches are coupled to a third output port 33*c*.

There are practical difficulties in implementing this reduced complexity configuration. It is desirable for improved performance to utilize diodes shunt-mounted between the secondary ports of each SP3T switch and a ground plane, not shown. The diodes in the SP3T switches should, therefore, be located an odd multiple of λg/4 from the output ports 33*a*–33*c* so that the diodes biased for a short-circuit will reflect an open circuit at associated output port. For maximum bandwidth, the electrical length between the junction and the diodes should be λg/4 where λg is the wavelength in the transmission lines at the center frequency of the operating band. This presents a significant topological problem, especially at higher frequencies.

Figure 11:
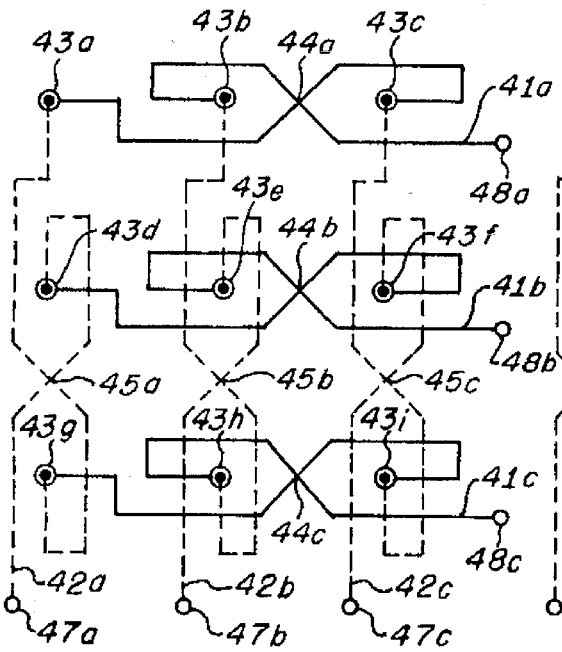
FIG. 11 is a representation of the circuit topology of a square lattice 3×3 transfer switch.

Refer now to FIG. 11, wherein circuit topology on a two layer printed circuit board constituted in accordance with the invention is shown for a 3×3 transfer switch. The routing of transmission lines 41a–41c printed on the upper layer is depicted as solid lines while the routing of transmission lines 2*a*–42*c* printed on the lower layer is depicted as dashed lines. Nine diodes 43*a*–43*c* are located at the inter-deck connections which are arranged in a substantially square lattice. The two-layer construction, nominally square lay-out of diodes, and inter-deck connections allows the interconnection of each row of diodes to junctions 44*a*, 44*b*, and 44*c* on the upper layer through λg/4 line lengths while simultaneously allowing the interconnection of each column of diodes to junctions 45*a*, 45*b*, and 45*c* on the lower layer also through λg/4 line lengths.

This transfer switch may be operated to commute and invert the sequence of signals at the input ports as needed to implement the invention. Referring again to FIG. 11, let A, B, and C represent the sequence of signals at input ports 47A, 47B, and 47C, respectively. Each diode has two states: State 1 which makes the connection and state 0 which breaks the connection. A connection is broken when a diode is in the conducting, state thereby creating a short to ground as will be subsequently explained. A state matrix may, therefore, be defined for all meaningful bias conditions of the diodes. The state matrices and associated signal sequences at the output ports are tabulated below for commutation and inversion respectively:

| COMMUTATION | | INVERSION | |
|---|---|---|---|
| Output Sequence | State Matrix | Output Sequence | State Matrix |
| 1 ABC | $\begin{bmatrix} 1 & 0 & 0 \\ 0 & 1 & 0 \\ 0 & 0 & 1 \end{bmatrix}$ | 4 CBA | $\begin{bmatrix} 0 & 0 & 1 \\ 0 & 1 & 0 \\ 1 & 0 & 0 \end{bmatrix}$ |
| 2 CAB | $\begin{bmatrix} 0 & 0 & 1 \\ 1 & 0 & 0 \\ 0 & 1 & 0 \end{bmatrix}$ | 5 BAC | $\begin{bmatrix} 0 & 1 & 0 \\ 1 & 0 & 0 \\ 0 & 0 & 1 \end{bmatrix}$ |
| 3 BCA | $\begin{bmatrix} 0 & 1 & 0 \\ 0 & 0 & 1 \\ 1 & 0 & 0 \end{bmatrix}$ | 6 ACB | $\begin{bmatrix} 1 & 0 & 0 \\ 0 & 0 & 1 \\ 0 & 1 & 0 \end{bmatrix}$ |

The output sequence refers to the signals exiting from output ports 48A through 48C, respectively, assuming signals A, B, and C enter the switch through input ports 47A, 47B, and 47C, respectively. The state matrices represent the state of each diode arranged as:

$$\begin{bmatrix} A & B & C \\ D & E & F \\ G & H & I \end{bmatrix}$$

in accordance with the reference numerals in FIG. 11. Noting that for proper operation, each junction must be connected to one and only one open-circuited diode, only the six listed switch states are meaningful and follow the rule that the sum of all rows and all columns is equal to unity.

Consider state matrix 1, for which the diodes 43*a*, 43*e*, and 43*i* are in the non-conducting state, all other diodes being in the conducting state. Consequently, due to the quarter wavelength spacing of the diodes from the junctions 44*a*–44*c* and 45*a*–45*c*, open circuits are reflected at the junctions for all paths except those through the inter-deck connections at the locations of diodes 43*a*, 43*e*, 43*i*. Therefore, a signal A at input port 47A follows a path along transmission 42*a*to the junction 45*a*, therefrom through the inter-deck connection at the location of non-conducting diode 43 to the junction 44*a*, and therefrom along transmission line 41*a* to the output port 48. Similarly, input port 47B is coupled to output port 48B and input port 47C is coupled to output port 48C. The input port-output port couplings for state matrix 2–6 may be similarly traced.

Figure 12:
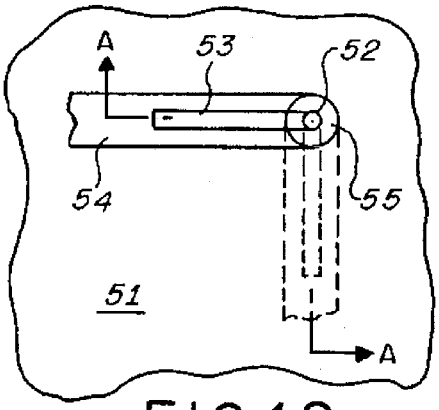
FIG. 12 is a representation of an area about an interconnection region in a square lattice 3×3 transfer switch.
Figure 13:
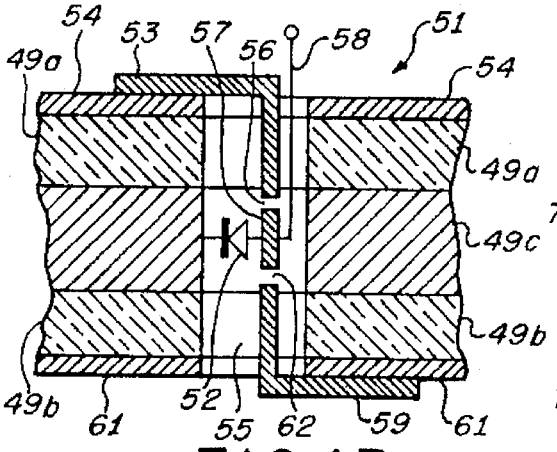
FIG. 13 is a cross sectional view, partially in schematic format, of the section A—A shown in FIG. 12.

Refer now to FIGS. 12 and 13 wherein like elements bear the same reference numerals. FIG. 12 is a top view of a region about an inter-deck connection 51 with a co-located diode 52, while FIG. 13 is a cross-sectional view through the cross-section A—A of FIG. 12. These figures are representative of all inter-deck connections. The circuit board comprises an upper dielectric layer 49*a* and a lower dielectric layer 49*b* separated by a ground plane 49*c*. A conductor 53 soldered to a transmission line 54 on the upper layer extends into an inter-deck passageway 55 to a d.c. blocking capacitor 56, formed by providing a small gap between conductor 53 and a conductor 57, which is coupled to a terminal 58 to receive d.c. bias voltages. Diode 52 is coupled between the printed circuit board ground plane 49*c* and the conductor 57. A conductor 59 soldered to a transmission line 61 on the lower layer 49*b* extends into the inter-deck passageway 55 to a second d.c. blocking capacitor 62, formed by providing a small gap between the conductors 57 and 59. The capacitors 56 and 62 are designed to provide a short circuit for the signals of interest and a d.c. open circuit to diode 52 bias voltages. Thus providing signal coupling between the transmission lines 53 and 61 while blocking d.c. from those transmission lines.

Figure 14:
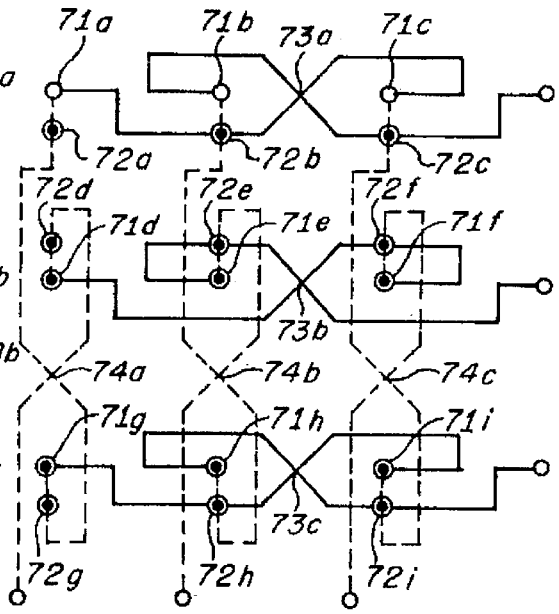
FIG. 14 is a representation of the circuit topology of a rectangular lattice 3×3 transfer switch.

Collocating the diodes 43*a*–43*i* with the inter-deck connections of the circuit board, as shown in FIGS. 11–13, presents difficulty in assembly and requires the development of a special diode package to ease this problem. This difficulty may be overcome by rectangularizing the inter-deck lattice, as shown in FIG. 14. This topology spaces the rows of the inter-deck 10% closer as compared to the square lattice of FIG. 11. The diodes 72*a*–72*i* may all be located on the lower layer approximately 0.03 λg from the inter-deck connections, while maintaining the λg/4 spacing between the diodes 72*a*–72*i* and the lower-layer junctions 74*a*–74*c*. This obviates the need for packaged diodes allowing the use of lower-cost chip diodes. To maintain the λg/4 electrical length from the diodes to the 72*a*–72 to the upper layer junctions 73*a*–73*c*, the line lengths on the upper layer may be correspondingly 0.03 λg shorter.

Figure 15:
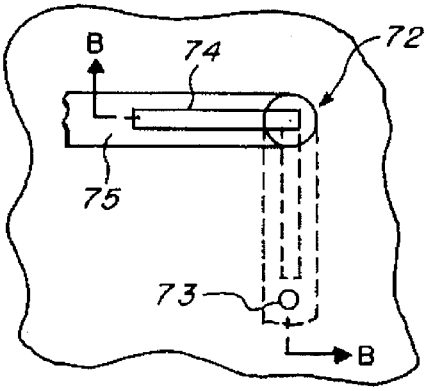
FIG. 15 is a representation of an area about an interconnection region including the switching diode location.
Figure 16:
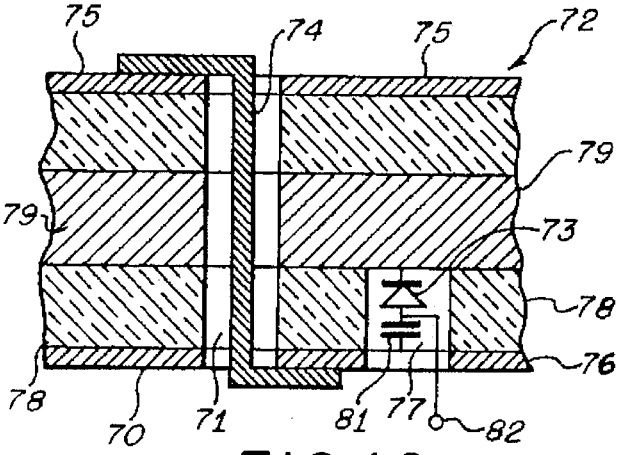
FIG. 16 is a cross sectional, partially in schematic format, of the section B—B shown in FIG. 15.

FIG. 15 is a top view of a region about an inter-deck connection 72 and a diode 73 location. FIG. 16 is a cross sectional view through the cross-section B—B in FIG. 15. In FIGS. 15 and 16 like elements bear the same reference numeral. A conductor 74 extends through a passageway 71 and is configured so that it may be soldered to a transmission line 75 on the upper layer and a transmission line 76 on the lower layer. A bore hole 77 of suitable diameter extends through the transmission line 76 and lower layer dielectric 78 to a metallic ground plane 79. Diode 73 is coupled to the ground plane 79 and, via a capacitor 81, to the transmission line 76. A terminal 82 for providing d.c. bias voltage to the diode 73 is coupled, via lead line 83, to a location between the capacitor 81 and the diode 73.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A commutation switch having a plurality of input ports coupled respectively in selectable sequences to an equal plurality of output ports comprising:

at least two transfer switches each having a multiplicity of input ports and a multiplicity of output ports equal to said multiplicity of input ports, said multiplicity of input ports of said at least two transfer switches in combination being said plurality of input ports and said multiplicity of output ports of said at least two transfer switches in combination being said plurality of output ports, said at least two transfer switches constructed and arranged to provide selectable pairings of input port and output port along signal propagating paths, said input ports and said output ports arranged such that each input port is positioned between two output ports so that input and output ports alternate;

each of said at least two transfer switches including a plurality of unidirectional current conducting devices having conducting and nonconducting states, each shunted across said signal propagating paths a distance of one quarter wavelength of a predetermined propagating signal from an input port and one quarter of said wavelength from an output port.

2. A commutation switch in accordance with claim 1 wherein each of said at least two transfer switches have first and second selectable commutation sequences of respective input port to output port couplings, said second selectable commutation sequences being inversions of said first selectable commutation sequences.

3. A commutation switch in accordance with claim 2 wherein said multiplicity of said input and output ports of said commutation switch is a binary number.

4. A commutation switch in accordance with claim 1 wherein said at least two transfer switches include at least one 2×2 transfer switch constructed and arranged to couple two input ports to two output ports in a selectable one of two input port to output port pairings, said plurality of unidirectional current conducting devices is equal to four, and wherein said at least one 2×2 transfer switch includes said four unidirectional current conducting devices, said unidirectional current conducting devices operable to provide said selectable input port to two output port pairings.

5. A commutation switch in accordance with claim 4 wherein said two input ports and said two output ports of said at least one 2×2 transfer switch are positioned on a circular signal propagating path having a circumference equal to two wavelengths of said predetermined propagating signal so that said input ports and said output ports alternate with an input port spaced one-half of said wavelength of predetermined propagating signal on said circumference from an output port.

6. A commutation switch having a plurality of input ports coupled respectively in selectable sequences to an equal plurality of output ports comprising:

at least two transfer switches each having a multiplicity of input ports and a multiplicity of output ports equal to said multiplicity of input ports, said multiplicity of input ports in combination being said plurality of input ports and said multiplicity of output ports in combination being said plurality of output ports, said at least two transfer switches constructed and arranged to provide signal propagating paths from said input ports to said output ports;

said at least two transfer switches each include a multiplicity of single pole Q throw (SPQT) switches which couple a primary port to a selectable one of Q secondary ports, said SPQT switches arranged to provide a M×M commutation switch having said first and second commutation sequences, and wherein said at least two transfer switches each including Q unidirectional current conducting devices respectively coupled between said Q secondary ports and a node to which said Q unidirectional current conductive devices and said primary port are coupled, each unidirectional current conducting device positioned an odd multiple of one quarter wavelength of a predetermined propagating signal from said node.

7. A commutation switch in accordance with claim 6, wherein Q is equal to three to provide SP3T switch.

8. A transfer switch comprising:

a multiplicity of input ports and a multiplicity of output ports equal to said multiplicity of input ports:

a first dielectric layer having a first surface;

a second dielectric layer having a second surface;

an electrical conducting layer between said first and second dielectric layers;

said multiplicity of input ports on said first surface;

said multiplicity of output ports on said second surface;

inter-deck means for providing couplings between said first and second surfaces;

first and second conducting means on said first and second surfaces, respectively coupled to said input ports and said output ports, said first and second conducting means coupled to said inter-deck means for providing signal propagation paths between said multiplicity of input ports and said multiplicity of output ports, said signal propagation paths having path cross-overs positioned an odd multiple of one quarter of a wavelength of a predetermined propagating signal from said inter-deck means; and unidirectional current conducting means collocated with said inter-deck means and coupled to said first conducting means, said second conducting means, and said electrical conducting layer, said undirectional current conducting devices operable to couple said signal propagation paths of said first conducting means to signal propagation paths of said second conducting means such that said input ports are coupled to said output ports in selectable predetermined input port-output port pairings.

9. An apparatus in accordance with claim 8 further including at least an additional one of said transfer switch to provide at least two transfer switches each having a multiplicity of input ports and a multiplicity of output ports equal to said multiplicity of input ports, said at least two transfer switches forming a commutation switch having a plurality of input ports and a plurality of output ports with said multiplicity of input ports of said at least two transfer switches in combination being said plurality of input ports and said multiplicity of output ports of said at least two transfer switches in combination being said plurality of output ports, said at least two transfer switches arranged to provide signal propagating paths from said plurality of input ports to said plurality of output ports in predetermined selectable input port-output port pairings.

10. An apparatus in accordance with claim 9 further including a plurality of antenna elements arranged to form an array antenna, said plurality of antenna elements being of equal number and respectively coupled to said plurality of output ports.

11. A transfer switch switch comprising:

a multiplicity of input ports and a multiplicity of output ports equal to said multiplicity of input ports;
a first dielectric layer having a first surface;
a second dielectric layer having a second surface;
an electrical conducting layer between said first and second dielectric layers;
said multiplicity of input ports on said first surface;
said multiplicity of output ports on said second surface;

first and second conducting means on said first and second surfaces, respectively, coupled to said input ports and said output ports, said first and second conducting means coupled to said inter-deck means for providing signal propagation paths between said multiplicity of input ports and said multiplicity of output ports, said signal propagation paths having path cross-overs on said first and second surfaces;

inter-deck means for coupling said first conducting means to said second conducting means;

unidirectional current conductive means coupled between said first conducting means and said electrical conducting layer, positioned a predetermined distance from said inter-deck means and an odd multiple of a quarter of a wavelength of a predetermined signal from said path cross overs for coupling signal propagation paths of said first conducting means to signal propagation paths of said second conducting means such that said input ports are coupled to said output ports in predetermined input port-output port pairings.

12. An apparatus in accordance with claim 11 further including at least an additional one of said transfer switch to provide at least two transfer switches each having a multiplicity of input ports and a multiplicity of output ports equal to said multiplicity of input ports, said at least two transfer switches forming a commutation switch having a plurality of input ports and a plurality of output ports with said multiplicity of input ports of said at least two transfer switches in combination being said plurality of input ports and said multiplicity of output ports of said at least two transfer switches in combination being said plurality of output ports, said at least two transfer switches arranged to provide signal propagating paths from said plurality of input ports to said plurality of output ports in predetermined selectable input port-output port pairings.

13. An apparatus in accordance with claim 12 further including a plurality of antenna elements arranged to form an array antenna, said plurality of antenna elements being of equal number and respectively coupled to said plurality of output ports.

14. An array antenna having M elements arranged about a perimeter of a cylinder, switch means for switachably coupling to N of the M elements, the ratio or M to N being an integer, and commutation means coupled to the switch means for commutating N signals coupled to input ports thereof to provide predetermined sequences of the N signals to the N elements, wherein the commutation means comprises:

at least two transfer switches each having a multiplicity of input ports, said multiplicity of input ports of said at least two transfer switches providing a total of N input ports, and a multiplicity of output ports, said multiplicity of output ports being equal to said multiplicity of input ports, said at least two transfer switches constructed and arranged to provide signal propagating paths from said input ports to said output ports for signals having a predetermined signal wavelength;

each of said at least two transfer switches including a plurality of unidirectional current conducting devices having conducting and nonconducting states, respectively shunted across signal propagating paths and positioned on said signal propagating paths between input and output ports in a manner to provide a distance of one quarter of said predetermined signal wavelength between an input port and an unidirectional current conducting device and a distance of one quarter of said predetermined signal wavelength between an output port and a unidirectional current device.

15. An array antenna in accordance with claim 13 wherein each of said at least two transfer switches have first and second selectable commutation sequences of respective input port to output port couplings, said second selectable commutation sequences being inversions of said first selectable commutation sequences.

16. An array antenna in accordance with claim 13 wherein said multiplicity of said input and output ports of said commutation switch is a binary number.

17. An array antenna in accordance with claim 13 wherein said at least two transfer switches include at least one 2×2 transfer switch constructed and arranged to couple two input ports to two output ports in a selectable one of two input ports to output ports pairings, said plurality of unidirectional current conducting devices is equal to four, and wherein said at least one 2×2 transfer switch includes said four unidirectional current conducting devices respectively positioned on signal propagating paths one quarter of said predetermined signal wavelength from said two input ports and one quarter of said predetermined signal wavelength from said two output ports, said unidirectional current conducting devices operable to provide said selectable one of said two input ports to output ports pairings.

18. An array antenna in accordance with claim 17 wherein said input ports and said output ports of said at least one 2×2 transfer switch are alternately positioned on a circular propagating path having a circumference equal to two times said predetermined signal wavelength with an input port spaced one-half of said predetermined signal wavelength on said circumference from an output port and a unidirectional current conducting device positioned between each input and output port one quarter of said predetermined signal wavelength from adjacent input and output ports.

19. An array antenna having a plurality of input ports coupled respectively in selectable sequences to an equal plurality of antenna elements comprising:

at least two transfer switches, each having a multiplicity of input ports and a multiplicity of output ports equal to said multiplicity of input ports, said multiplicity of input ports of said at least two transfer switches in combination being said plurality of input ports and said multiplicity of output ports of said at two transfer switches in combination being said plurality of output ports, said plurality of output ports being respectfully coupled to said plurality of antenna elements, said at least two transfer switches constructed and arranged to provide signal propagation paths from said input ports to said output ports and wherein;

said at least two transfer switches each include a multiplicity of single pole Q throw (SPQT) switches which couple a primary port to one of Q secondary ports, said SPQT switches arranged to provide a M×M computation switch having said first and second commutation sequences, said primary and secondary ports of said SPQT switch are each coupled via respective propagation paths to a node, and wherein said at least two transfer switches each include Q unidirectional current conducting devices respectively coupled between said Q secondary ports and said node, each unidirectional current conducting device positioned an odd multiple of one quarter wavelength of a predetermined propagating signal from said node.

20. An array antenna in accordance with claim 19 wherein Q is equal to three to provide a SP3 T switch.

* * * * *